United States Patent [19]

Seragnoli

[11] 3,988,876

[45] Nov. 2, 1976

[54] DEVICE FOR SEALING WRAPPERS OF CANDIES AND THE LIKE

[75] Inventor: Enzo Seragnoli, Bologna, Italy

[73] Assignee: G. D. Societa per Azioni, Italy

[22] Filed: Mar. 20, 1975

[21] Appl. No.: 560,137

[52] U.S. Cl. ..... 53/124 A; 53/234; 53/379; 53/388

[51] Int. Cl.[2] ..... B65B 11/36

[58] Field of Search ..... 53/234, 375, 388, 379, 53/124 A, 387; 93/12 C

[56] References Cited

UNITED STATES PATENTS

| | | | |
|---|---|---|---|
| 1,626,378 | 4/1927 | Armstrong | 53/379 X |
| 2,234,175 | 3/1941 | Jackson | 53/379 X |
| 2,639,568 | 5/1953 | Brook | 53/388 X |
| 3,282,760 | 11/1966 | Guetierrez | 53/388 X |
| 3,405,505 | 10/1968 | Mistarz | 53/375 X |
| 3,670,475 | 6/1972 | Seragnoli | 53/234 |
| 3,802,325 | 4/1974 | Bardenhagen | 93/12 C X |

*Primary Examiner*—Travis S. McGehee
*Attorney, Agent, or Firm*—Robert E. Burns; Emmanuel J. Lobato; Bruce L. Adams

[57] ABSTRACT

A device for sealing candies in wrappers comprises a rotary disk with circumferential compartments, each receptive of a candy wrapped in tip style, with folded tips of the wrap upwardly exposed. The disk conveys the so-received candies, intermittently, past a presser, which presses each candy into its compartment to provide the candy with its proper shape and dimensions. The disk then conveys the so-shaped and dimensioned candy to devices which heat-seal the folded tips and then cool the candy.

10 Claims, 3 Drawing Figures

DEVICE FOR SEALING WRAPPERS OF CANDIES AND THE LIKE

BACKGROUND OF THE INVENTION

This invention relates to machines which form individual pieces of candy and other similar products, then wrap them in in what is known as the "tip or pin" style, and finally perform certain transfer, sealing, cooling and ejection operations.

DESCRIPTION OF THE PRIOR ART

It is known, particularly in the very high output speed machine according to Pat. 3,670,475 in the name of the Assignees hereof, to divide a continuous candy rope into individual parallelepiped products.

The products, fed one at a time between two horizontal guides by a pusher member, intercept cuttings of wrapping material.

During a subsequent transfer carried out by a wheel or rotatable head moved intermittently and provided with a plurality of pairs of gripper devices for holding on to the products and the respective cuttings of wrapping material, fixed and movable folding fingers attend to the carrying out of the various wrapping operations.

Pusher members transfer the products into pockets in a continuously moving chain or belt, for further transfer past one or more electrically heated plates for heat sealing the wrap on the products, after which a cooling sleeve cools them.

The number of welding plates destined to operate on one or more sides of the wrap depends on the type of wrap to be realized, since one of the particularly advantageous characteristics of this type of machine is that it is able, when slight modifications are made, to wrap in various wrapping styles.

The machine according to the patent can produce a tip style wrap, and according to the present invention such wraps are sealed or welded. For this purpose it is sufficient, as is known, to have one single welding plate operating on one side of the parallelepiped product, on which two of the wrap are folded.

In order to facilitate the insertion of the products in the chain or belt which, as previously stated, moves continuously, the pockets have had to be longer than the products in the direction of their movement to exclude any possibility of the products getting knocked as they go in.

Bearing in mind the plastic nature of the products under consideration, the failure of the walls of the pocket to fit closely around the products results in their original parallelepiped shape being notably deformed. This deformation is aggravated by the pressing action of the welding plate and of the cooling means.

This problem, moreover, already tends to arise in part at the time the wrapping operations are carried out on the rotatable head. At that time the sides of each product not flush up against the surface of the grippers tend to swell and to bulge.

SUMMARY OF THE INVENTION

The object of the present invention is, therefore, to overcome all the aforementioned difficulties through the realization of a device which is able to deliver up wrapped products of a perfect parallelepiped shape; in which every cause for deformation of the product has been eliminated; and which, furthermore, is able to correct any deformation which may have occurred during the wrapping stages. A further object of the present invention is, in conformity with the preceding object, to realize a machine of the above mentioned type, which is able to attain higher operating speeds than the machines of a known type.

The machine, comprising the new device, has an intermittently rotatable wheel provided with a plurality of grippers, each for grasping a plastic product and a sheet of wrapping material; fixed and movable folding fingers located along the periphery of the wheel, for wrapping the product in the sheet in the tip style; means for ejecting the wrapped products from the rotatable wheel; a rotatable conveyor disk having pockets; means for individually inserting successive products in successive, respective ones of these pockets, at an intake point on the circumference of the disk; and, successively along the path followed by the disk from the intake point: heating means for welding the tips of the wrap; means for cooling the products and means for the final expulsion of the wrapped products from the pockets according to the invention, the pockets of the conveyor disk are so shaped that they are able to house parallelepiped products of the exact size proper for the wrapped and finished products and, between the intake and the heater there is provided a dual purpose presser device which moves vertically in a reciprocating fashion to flatten and give emphasis to the folds in the wrap and to conform the products with the pockets by pressing them into the pockets.

BRIEF DESCRIPTION OF THE DRAWINGS

Further characteristics and advantages will emerge more clearly from the following detailed description of a preferred but not the sole form of embodiment for the machine for forming candies and for wrapping them, according to the invention. In the drawing

DESCRIPTION OF THE PREFERRED EMBODIMENT

Figure 1:
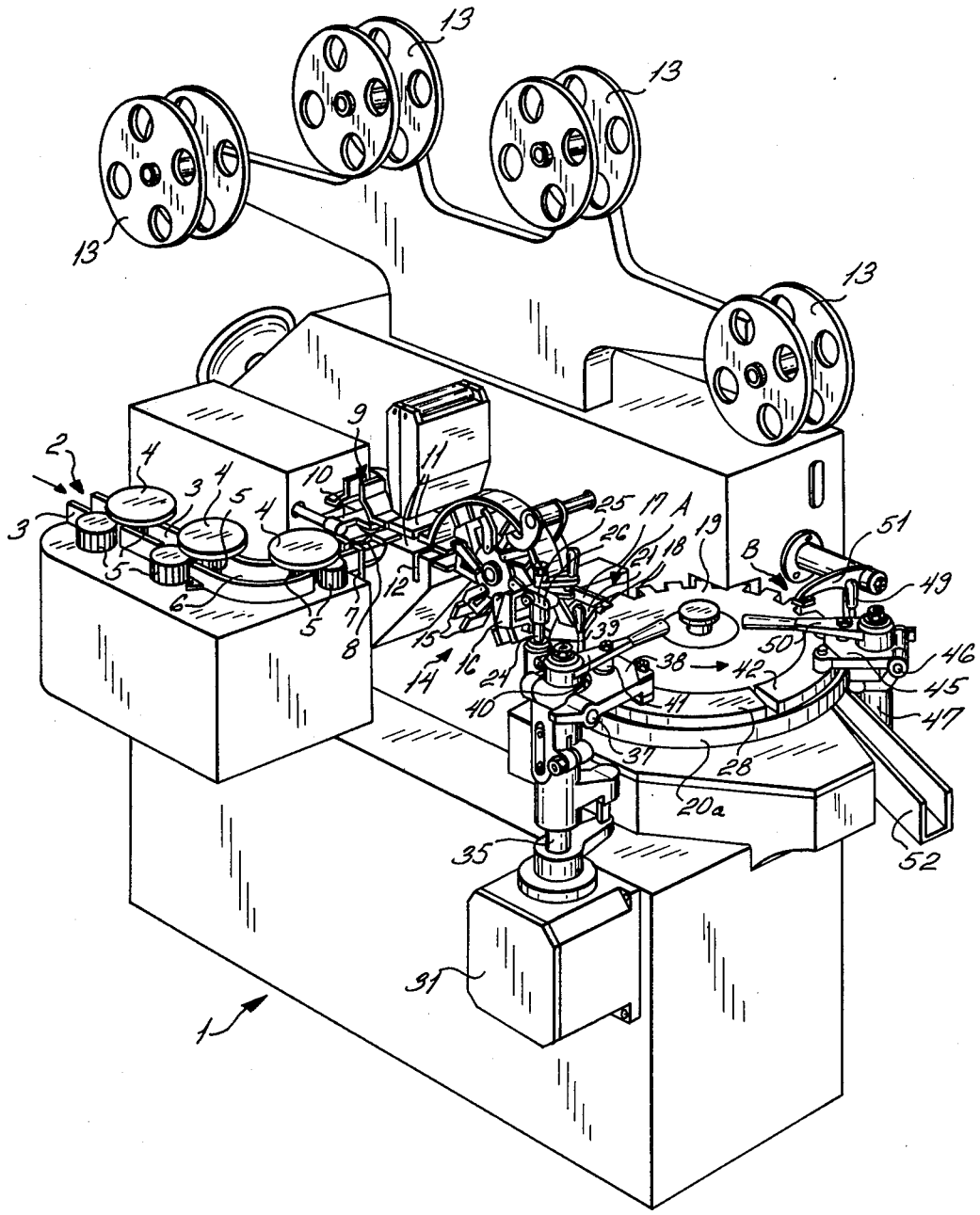
FIG. 1 shows schematically, in a front perspective view, the entire machine comprising the new device.

With reference to FIG. 1, at 1, shown in its entirety, there is a machine for forming and wrapping candies or other similar products, out of a continuous candy rope, in accordance with the aforementioned Patent. The machine comprises the product-shaping and sealing device according to the present invention.

In conformity with the description given in the above mentioned Patent, the insertion and forward movement of the continuous candy rope takes places through a channel 2, delimitated by two vertical walls 3, inside which it is progressively roughed and shaped, laterally and at the base by the walls 3 and by the bottom of the channel, respectively, and on the top by a succession of disks 4.

The forward motion of the continuous candy rope inside the channel 2, entrusted to a series of rollers 5 in pairs, proceeds uninterruptedly up as far as a curvature 6. Thereafter and from a final pair of rollers onwards it becomes intermittent.

At the far end of channel 2, a cutting device 7 divides the rope into individual parallelepiped products which as mentioned above, are still plastic, so that they can be plastically deformed. Each of these products is inserted into a pocket 8 belonging to a wheel 9 with pockets in it, rotatable around a horizontal shaft intermittently in a counter clockwise direction, which is at a standstill, intermittently, with successive ones of the pockets in a first station. After rotating through 90°, each pocket 8 halts in a second station where a pusher member 10 provided with a horizontal reciprocating motion drives the products from the pocket into a space between two horizontal, parallel guides 11.

Running transversely across the guides 11 there is a vertical slit 12 through which successive cuttings of wrapping material supplied by reels mounted on reel carriers 13 are intermittently supplied.

As each product moves along, its front side in the movement direction engages with and drags along a cutting of wrapping material, on which the two guides 11 perform an initial U-folding operation, causing the cutting to become attached to the top and bottom sides of the product.

The wrapping operations continue through fixed and movable folding fingers. The movable ones include fingers that oscillate in the inside of a horizontal shaft mounted wheel 14, parallel with the aforementioned wheel 9. Wheel 14 rotates intermittently and is provided with a plurality of pairs of radial grippers 15. As already indicated, the gripper action often causes irregular swelling of side portions of the plastically deformable products, adjacent the product portions directly engaged by the grippers.

Partially wrapped products are expelled from wheel 14 in a station diametrically opposed to that where the intake occurs, the expulsion being carried out by an extractor 16 which, sliding radially with respect to the wheel 14, inserts them between two horizontal, parallel guides. By wrap-engaging and bending action of these, the tip style wrap also called "tip or pin wrap" is completed as more fully described in said patent and summarized hereinafter.

At this juncture, the improved exiting device according to the present invention carries out a number of operations on the products, the wrapping of which complies with the description given in the cited patent.

Past the final extremity of the guides 17, the products, laying flat with the tips folded on their upper side, are inserted by the extractor 16 into a pocket 18. The pocket 18, waiting at a point corresponding to where an entry station A is located, belongs to a disk or the disk or plate 19. The disk is mounted on a central vertical shaft 19*a* around which it is intermittently rotatable in a counter clockwise direction. The pockets 18 of the disk are open on the edge and on the upper and lower sides of the disk and are of the exact size to suit parallelepiped products of the proper shape and dimentions.

A fixed horizontal plate 20 is provided, underlying the disk 19 and having, as shown, an upstanding edge 20*a* coaxial with the disk. This edge extends from the entry station A to an exiting station B. The plate and edge 20, 20*a* serve as a supporting and retaining member for the products. They, while stopping in a station immediately after the entry station A, are subjected at the top to the action of a horizontal presser plate member 21 overlying a pocket 18 and adjacent areas of disk 19. This member 21 is provided with a vertical reciprocating motion, including a downward pressing stroke and an upward return stroke. The downward pressing stroke has the task of flattening the sides of each product and emphasizing or sharpening the tips of the wrap, as well as of bringing the thickness of the plastic paralleiped to its proper measure over the entire surface of each product, by straightening any bulges and thereby preparing the products for the further processing stages through which they have to pass.

The presser member 21, which operates every time the plate 19 comes to a halt, takes its drive from a horizontal shaft 22, carried by the frame of the machine 1.

Through an eccentric disk 23 and a vertical shaft 24, the horizontal shaft 22 passes a reciprocating motion on to a block 25 provided wth a horizontal pin 26 to which the presser member 21 is hinged.

Figure 2:
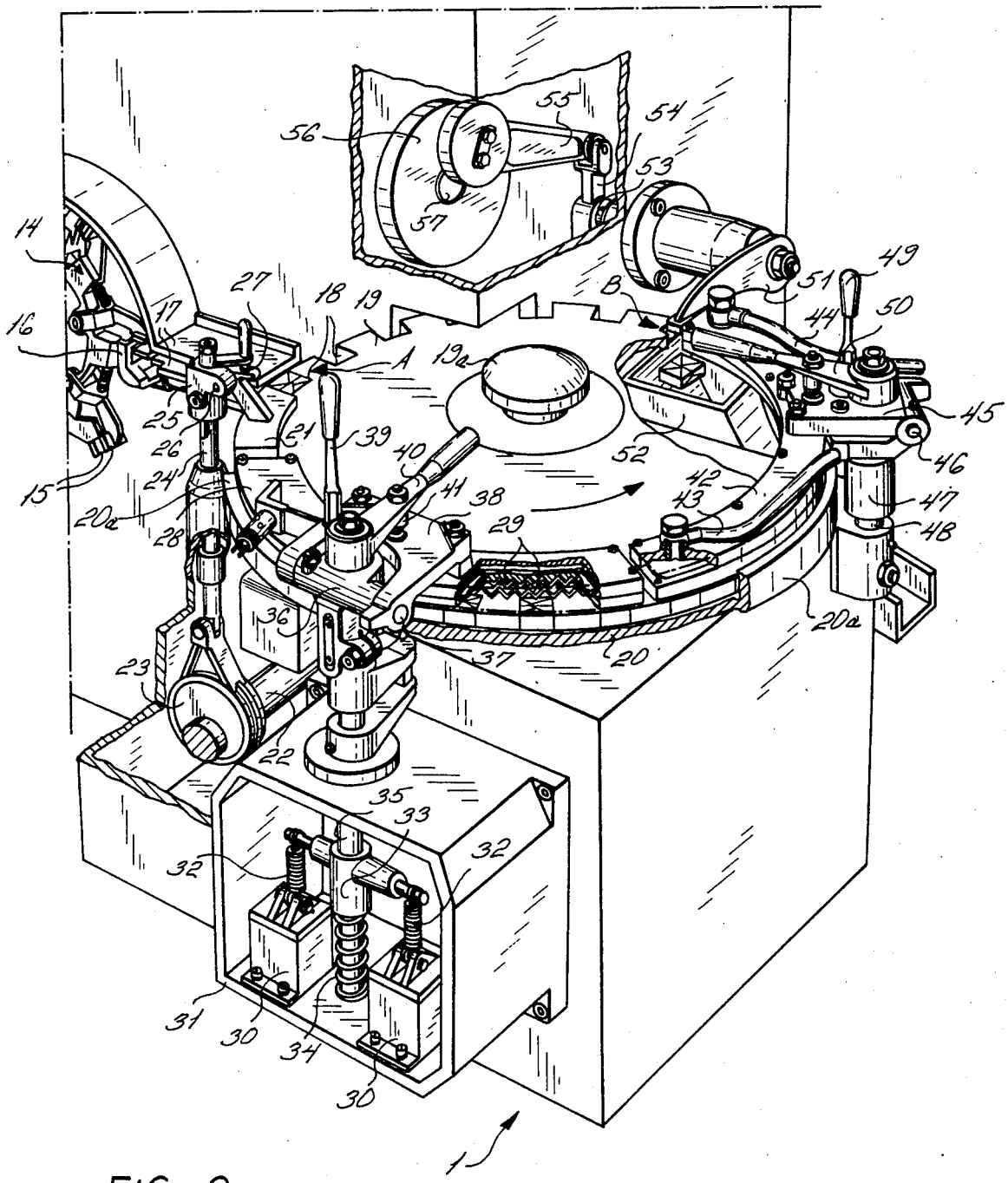
FIG. 2 shows, on a larger scale and again as a perspective view, the new product-shaping and sealing device of the machine, with some parts broken off.

Under normal operating conditions, the presser member 21 is locked on to its support means 25, 26 in the position shown in FIG. 2, but in cases of emergency or for maintenance operations, it is unlocked and caused to rotate upwards around the pin 26 by removal of a stay 27 provided with a grip and pivoted to block 25.

Upon completion of the described operation and in a subsequent series of stations, the upper sides of the wraps, on which the tips are folded, are subjected to a welding operation by a plate 28 which is heated by a resistance 29.

The plate 28, shaped in the form of a circular segment, extends arcuately over a suitable number of stations in each of which the product intermittently halts, in its progress with the conveyor disk.

Under normal operating conditions, the plate 28 slidingly contacts the plate or disk 19. For the event that the intermittent movement of the disk stops, and so as to prevent the products from too prolonged a resulting contact with the heated surface, a device is provided for automatically raising the plate 28. This device comprises to electromagnets 30 housed in a compartment 31 integral with the frame of the machine 1. Through springs 32, these operate two opposite, horizontal arms with which a vertical sleeve 33 is provided.

Sleeve 33 is upwardly biassed, at its bottom, by a spring 34 and is locked on to a vertical shaft 35 which can slide axially through the compartment 31.

Outside the compartment 31, the upper extremity of the shaft 35 is integral with a block 36y connected, by means of a pivot 37, to a support 38 of the plate 28.

In the event of a stoppage of the machine, and thus consequentially of the conveyor plate 19, the two electromagnets 30 are automatically de-energized, the machine being driven by electric power, as is shown in the above-mentined patent. As a result, due to the action of the spring 34, the shaft 35 moves axially upwards and removes the plate 28 from the upper surface of the plate 19.

While under normal operating conditions the plate 28 is locked in the position shown in FIG. 2, in cases of emergency or for maintenance operations, it can be rotated around the pivot 37 by manually moving a vertical lever 39 integral with the support 38, after first having freed a horizontal rod 40 hinged on to the block 36 and provided with a stay 41 operating on the support 38.

Once the wrap welding operation has been brought to an end in the way described, the wrapped products are immediately subjected to a cooling operation.

This is entrusted to a plate 42, also shaped in the form of a circular segment, extending above the plate 19 between the final extremity of the welding plate 28 and the wrapped product exiting station B.

The plate 42, wherein cooling water is injected through a pipe 43 and cleared through a pipe 44, is carried by a support 45 connected through a pivot 46 horizontally to a sleeve 74 keyed on to the lower extremity of a vertical shaft 48 carried by the frame of the machine.

In an identical way to that seen for the plate 28, the plate 42 can also be raised in the case of need by rotating it around the pivot 46, manually using a vertical lever 49, after a horizontal rod 50, provided with a grip and having the same purpose as the rod 40, has been freed.

Beyond the final extremity of the cooling plate 42 there follows the exiting station B in which the products, now properly wrapped, shaped and sealed, are sent to a collating device by an ejector member 51 provided with an oscillating movement in a vertical plane, which engages with the top side of the products waiting in the station B during its outgoing oscillation, thereby forcing them into a chute 52.

The ejector member 51 takes its oscillating movement from one end of a horizontal shaft 53 carried by the frame of the machine 1.

The shaft 53 is then connected, via a link rod 54, to one end of a connecting rod 55, the other extremity of which is pivoted to a disk 56 rotated by a horizontal shaft 57 of the machine.

Figure 3:
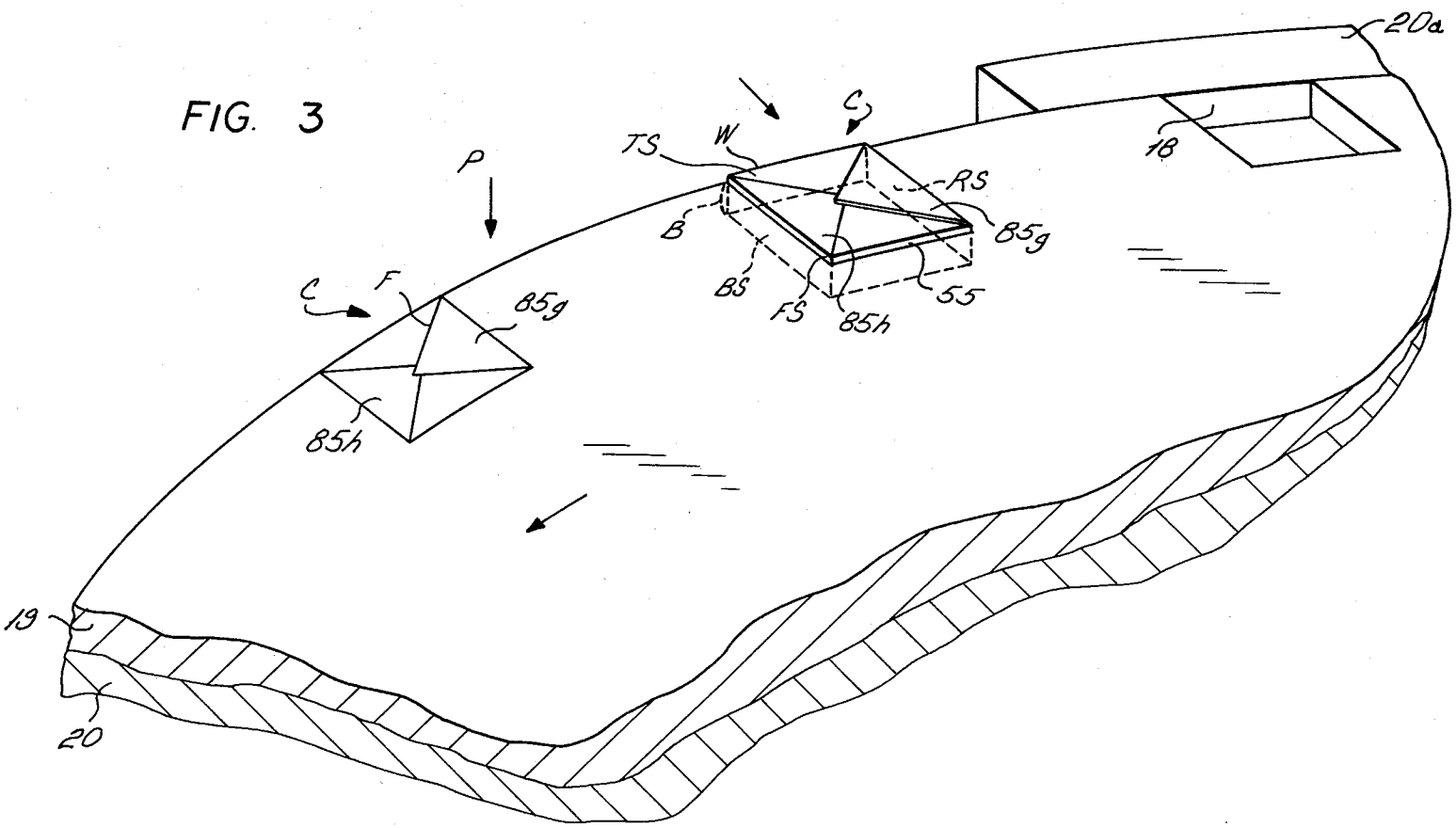
FIG. 3 shows a portion of the device on a still larger scale.

The tip-style wrapping, produced in accordance with the abovementioned patent, can be summarized as follows in connecttion with FIG. 3. Candy C has a top surface TS: a bottom surfae BS paralllel thereto; a front surface FS; a rear surface RS parallel thereto; and parallel side surfaces SS. Two triangular tips 85*g* 85*h* of wrap W are produced on top surface TS by the consecutive actions of the folding devices cooperating with gripper wheel 14 and of the wrap-bending guides 17, while bulges B are often produced on the front, side and rear surfaces by the action of grippers 15. The triangular tips 85*g*, 85*h* have base portions at the ends FS, RS and have apex portions which converge toward one another; one of the apex portion advantageously overlaps the other, as shown. In each pocket 18 of conveyor disk 19 a candy C is received with the tips 85*g*, 85*h* of the wrap upwardly exposed as shown in FIGS. 2 and 3. Initially the top surface TS of candy C and the folds of tips 85*g*, 85*h* tend to be slightly above the top surface of disk 19, since the final bottom edge of the upper guide plate and tip folding member 17 is slightly above the latter surface, as also shown in FIGS. 2 and 3. Also, initially each pocket 18 is only partly filled by the respective candy C, as already indicated. From inspection of the drawing it will be clear that, pursuant to the downward pressing action P of the presser plate member 21, the thickness of the candy C, between top and bottom surfaces TS, BS, is reduced to the thickness of the conveyor disk 19; portions of the plastic candy material are displaced by this action to the side, front and rear surfaces SS, FS and RS, which are restrained by the wlls of the pocket and by the edge 21*a*, therebyy straightening out any bulges B and conforming these surfaces to their proper shape as shown at the front of FIG. 3; and the folds of the tips 85*g*, 85*h* are sharpened or emphasized, by being pressed into flat, horizontal position on top surface TS. In such position, the tips are then welded by the action of heat sealing plate 28.

What is claimed is:

1. Apparatus for shaping plastic products, such as candies produced from a candy rope, and for heat sealing wraps thereon in tip-style, comprising:

a generally horizontal conveyor having upwardly and radially outwardly open pockets of parallelepiped shape, each receptive of a radially inwardly introduced plastic product wrapped in a heat-sealable wrap with folds providing tips upwardly exposed in the pocket; means for intermittently moving the conveyor to transfer the products to successive halting positions, at successive stations along the conveyor;

a presser plate disposed at a first of the successive stations and overlying a pocket and adjacent portions of the conveyor when the conveyor is in one of the halting positions; means for reciprocating the presser plate downwardly onto the conveyor and back upwardly away from the conveyor in synchronism with the halting of the conveyor in the halting positions to conform each product with the respective parallelepiped shape of the pocket and to sharpen the folds of the tips of the wrap; and heat-sealing means disposed at further ones of the successive stations for heat-sealing each tip to an adjacent portion of the wrap, on the product so conformed with said parallelpiped shape.

2. Apparatus according to claim 1 in which the means for reciprocating the presser plate comprises a rod guided for vertical reciprocatory movements; connector means at an upper end of the rod for maintaining a connection of the presser plate with the rod so that the plate moves with the rod; and eccentric disk means at a lower end of the rod for vertically reciprocatingly moving the rod.

3. Apparatus according to claim 2 in which the connector means includes means for selectively modifying the connection of the presser plate with the rod to inactivate the presser plate.

4. Apparatus according to claim 1 including means for producing, and receiving in the pockets of the conveyor, the plastic products wrapped in the wrap with folds providing the tips with mutually overlying apex portions.

5. Apparatus accordiing to claim 1 in which the heat-sealing means comprises a heater plate disposed to be in sliding contact with the tips of the wraps during the moving of the conveyor, and in heat-transfer position relative to the tips in the halting positions of the conveyor; and safety means for moving the heater plate out of the heat-transfer position in the event that the intermittent moving of the conveyor is discontinued.

6. Apparatus according to claim 5 in which the safety means comprises an electromagnetic device for holding the heater plate in its heat-transfer position, against resilient means for raising the plate from its heat transfer position.

7. Apparatus according to claim 6 including connector means for maintaining a connection of the heater plate with the electromagnetic device, and means for selectively modifying the connection of the heater plate with said device to inactivate the heater plate.

8. Apparatus according to claim 1 in which the conveyor is a circular, rotatable disk; the presser plate and the heat sealing means being located in arcuately shaped and angularly successive areas circumferential of the disk.

9. Apparatus according to claim 8 also including cooling means for cooling the heat-sealed tips; the cooling means being disposed in an arcuately shaped area angularly successive to the heating means and circumferential of the disk.

10. Apparatus according to claim 9 also including exiting means for removing products from the disk, said exiting means being disposed in an area angularly successive to the presser plate, heating means and cooling means and circumferential of the disk.

* * * * *